United States Patent [19]

Garland

[11] Patent Number: 4,646,526

[45] Date of Patent: Mar. 3, 1987

[54] METHOD AND APPARATUS FOR MAKING FRAGMENTARY ICE

[75] Inventor: Milton W. Garland, Waynesboro, Pa.

[73] Assignee: Frick Company, Waynesboro, Pa.

[21] Appl. No.: 881,329

[22] Filed: Jul. 2, 1986

[51] Int. Cl.[4] ..... F25C 1/00

[52] U.S. Cl. ..... 62/66; 62/123; 62/340; 62/532

[58] Field of Search ..... 62/123, 124, 532–534, 62/66, 340

[56] References Cited

U.S. PATENT DOCUMENTS

| | | | |
|---|---|---|---|
| 2,059,970 | 11/1936 | Robillard | 62/65 |
| 2,263,452 | 11/1941 | Birdseye | 62/65 |
| 3,162,019 | 12/1964 | Porter et al. | 62/67 |
| 3,178,899 | 4/1965 | Torobin et al. | 62/67 |
| 3,376,710 | 4/1968 | Hirtensteiner | 62/374 |
| 3,611,737 | 10/1971 | Alaburda et al. | 62/374 |
| 3,635,045 | 1/1972 | Astrom | 62/266 |
| 3,817,048 | 6/1974 | Burley | 62/64 |
| 3,824,799 | 7/1974 | Ganiaris | 62/123 |
| 3,835,658 | 9/1974 | Wilson | 62/123 |
| 4,470,202 | 9/1984 | Buxton et al. | 62/123 |
| 4,479,363 | 10/1984 | Gibson et al. | 62/63 |

*Primary Examiner*—William E. Tapolcai

*Attorney, Agent, or Firm*—Dowell & Dowell

[57] ABSTRACT

Fragmentary water ice is produced in an enclosure by metering water into a flowing body of liquid refrigerant having a greater density than the water or ice, lifting the ice out of the refrigerant and through a zone of further cooling in which the adhering liquid refrigerant, itself, is cooled and drained from the ice, and discharging the ice through an opening in the enclosure.

17 Claims, 2 Drawing Figures

$H_2O$
10
11
12
14
15
20
21
22
23
24
30
31
32
34
36
38
40
41
42
43
45
47
48
49
50
52
53
54
55
56
58
59
60
61
62
64
65
70
71
72
73
74
75
76
80
81
84
85
A
h

METHOD AND APPARATUS FOR MAKING FRAGMENTARY ICE

BACKGROUND OF THE INVENTION

1. Field of the Invention

The invention is in the field of fragmentary water ice making.

2. Description of the Prior Art

Most commercial ice production is in fragmentary form of which the three basic types are flake, tube, and plate.

Flake ice is produced by applying water to the inside or outside of a refrigerated drum. Ice removal devices fracture the thin layer of ice produced, breaking it free and permitting it to fall into an ice bin.

Tube ice is produced by freezing a falling film of water either on the outside of a stainless steel tube with evaporating refrigerant on the inside, or freezing water on the inside of tubes surrounded by evaporating refrigerant on the outside. The tube is then defrosted by the application of heat which permits the ice to slide off the tube into a breaker and then into a storage area.

Plate ice makers are those that build ice on a flat vertical surface to which water is applied, liquid refrigerant circulating within the plate. The ice is harvested either by applying hot gas to the refrigerant circuit of the plates or by flowing warm water on the back side of the plate.

The Buxton et al. U.S. Pat. No. 4,470,202 discloses the freezing of pharmaceutical substances or the like by introducing droplets into the bottom of a column of a liquid freezing medium and permitting the frozen droplets to rise to the surface to be harvested by a conveyor. The liquid freezing medium is refrigerated by external means. The liquid medium is circulated in counterflow to the ascent of the droplets to permit freezing in a column of less height than would be required in the absence of such counterflow.

The United States patent to Gibson et al. discloses a method of freezing a liquid such as cream by dispensing a stream of it from a nozzle onto a stream of liquified gas flowing along a downwardly inclined channel.

The Porter et al. U.S. Pat. No. 3,162,019 discloses an apparatus in which a liquid such as coffee extract is dispensed by droplets into a low temperature body of liquid, the droplets freezing and being removed by a conveyor.

The Torobin et al. U.S. Pat. No. 3,178,899 discloses a process of freeze concentrating a solution, such as that of a beverage, within an immiscible liquid.

The Burley U.S. Pat. No. 3,817,048 discloses the reduction of the liquid content of a sludge by first freezing the sludge in droplet form by contacting the droplets with an inert liquid refrigerant which is immiscible with the suspending medium of the sludge.

The Wilson U.S. Pat. No. 3,835,658 discloses the desalination of saline water by freezing, including forming a mixture of ice and concentrated saline water, by heat exchange with an evaporating liquid refrigerant, and separating the ice from the concentrated saline water.

The Robillard U.S. Pat. No. 2,059,970, Birdseye U.S. Pat. No. 2,263,452, Hirtensteiner U.S. Pat. No. 3,376,710, Alaburda et al. U.S. Pat. No. 3,611,737, and Astrom U.S. Pat. No. 3,635,045, disclose conveyors for moving a frozen packaged product from a liquid bath or spray upwardly, including subjecting the product in some cases, to a refrigerated air stream in its upward movement.

SUMMARY OF THE INVENTION

It is an object of the present invention to provide a method and apparatus for making water ice in fragmentary form in which the water is introduced in a predetermined metered flow into a relatively large stream of liquid refrigerant having the capacity to freeze the water rapidly into fragments of ice, and then separating the ice from the liquid refrigerant and returning the separated liquid refrigerant to the stream.

In carrying out the present invention, a housing is provided, having a moving stream of cooling medium carried in its lower portion into which the water is injected. A cooling means is preferably mounted above the liquid stream within the housing. The liquid medium is pumped in a circuit whereby it flows downwardly over the cooling means and returns to the stream. A conveyor is provided which lifts the ice particles from the stream upwardly within the housing and to a discharge opening, the conveyor passing through an air stream which circulates in heat exchange relation with the cooling means, and preferably with an auxiliary cooling means, thereby enhancing the removal of the liquid cooling medium from the ice fragments.

DESCRIPTION OF THE PREFERRED EMBODIMENT

Figure 1:
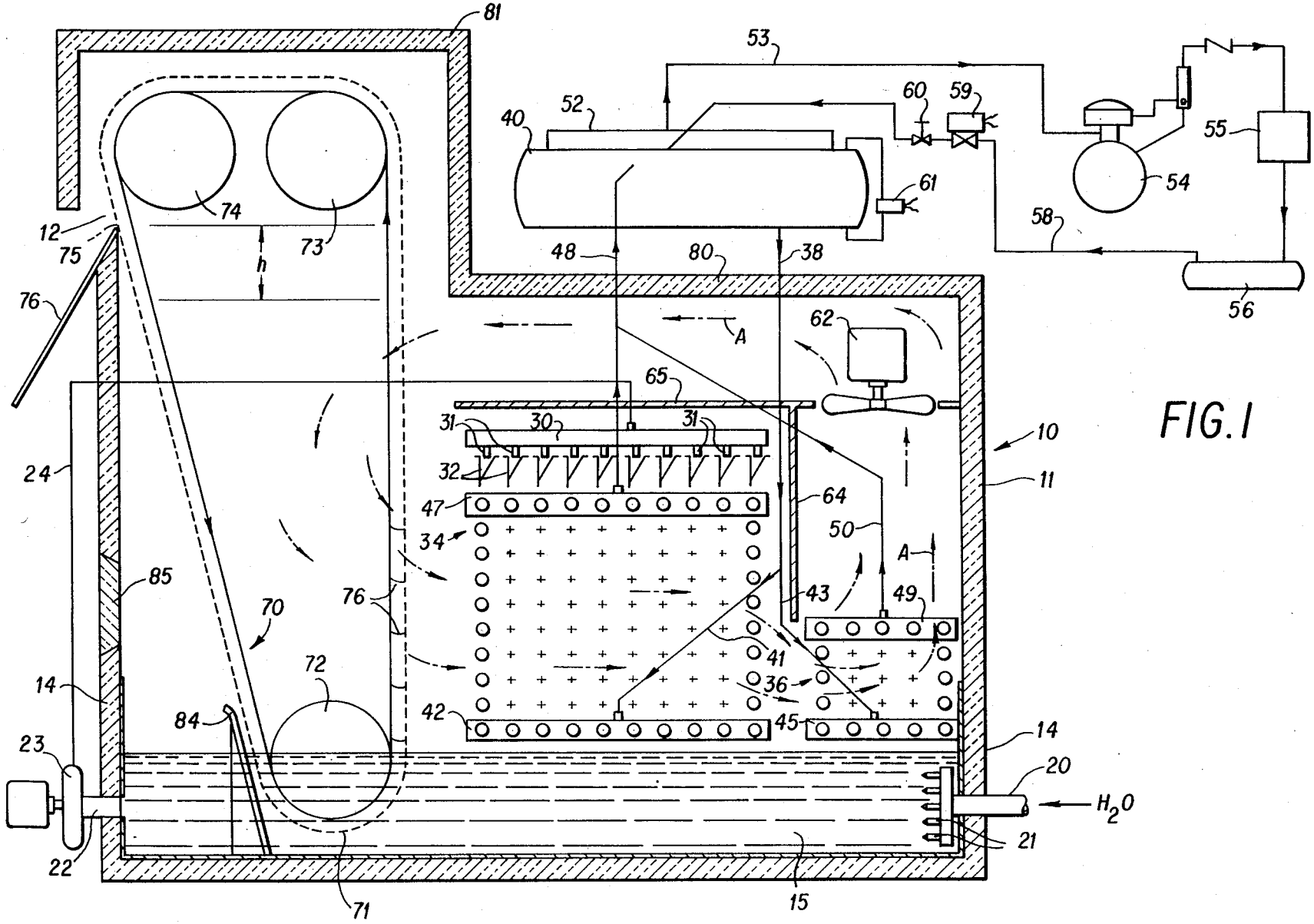
FIG. 1 is a schematic diagragm of an embodiment of the invention.

Referring to FIG. 1 of the drawing, a housing 10 is disclosed which preferably has insulation 11. The housing has an opening 12 for the discharge of ice as will be described.

The lower portion of the housing has a tank 14 for carrying liquid cooling medium or refrigerant 15, such as R11. An inlet pipe 20 is provided for the controlled injection of water beneath the liquid medium at one end of the tank 14 through one or more nozzles 21.

At the other end of the tank, a discharge pipe 22 is connected to a pump 23 having a discharge line 24 which leads upwardly and within the housing to a header 30. The header has individual discharge pipes 31 feeding into troughs 32 for dispensing the liquid medium over the coils 34 of an evaporator. After passing over the coils and in heat exchange relation therewith, the liquid medium falls back into the main body 15. Other means for cooling the liquid medium could be employed such as coils submerged in the medium with an agitator to promote heat exchange, or an external heat exchanger. However, the arrangement shown in the drawing is viewed as having advantages of efficiency in most instances.

Mounted alongside the evaporator 34 but outside of the path of the falling liquid medium is an auxiliary evaporator 36.

Refrigerant for the evaporators 34 and 36 is provided by a feed line 38 from a separator 40, the feed line having a branch 41 to a bottom header 42 of evaporator 34 and a branch line 43 to a bottom header 45 of evaporator 36. Evaporator 34 has a top header 47 connected by return line 48 to separator 40. Similarly, evaporator 36 has an upper header 49 connected by line 50 to return line 48 to the separator 40.

Refrigerant vapor in separator 40 is removed by outlet pipe 52 and suction line 53 to compressor 54. The compressor 54 discharges into condenser 55 and receiver 56 through line 58 and flow controls 59 and 60 back into separator 40 having level control 61.

Within the housing, a fan 62 is positioned to circulate air in stream "A" across the evaporators 34 and 36 upwardly around the divider walls 64 and 65 through a conveyor, which will be described, and back into the evaporator 34.

Positioned in the path of the moving air is a conveyor 70, driven by suitable means, not shown, having a lower portion 71 engaged by wheel 72 beneath the surface of the liquid medium 15. At its upper reach, the conveyor runs over wheels 73 and 74 and passes by a lip 75 of ledge 76 which directs the ice fragments discharged through the opening 12 to a suitable bin or collector below (not shown). The conveyor has a series of buckets 76 which engage and lift the ice fragments from the stream and which may be perforated or foraminous to permit drainage therefrom of the liquid medium.

The housing 10 preferably has a first upper wall 80 which is at a lower level than a second upper wall 81. The upper wall 80 is at an elevation spaced above the uppermost portion of the evaporator 34, thereby permitting air flow above the evaporator. Furthermore, the ice discharge opening 12 in the housing is at an elevation "h" above that of the housing upper wall 80, thereby providing a quiescent or stratified air layer between the level of the upper wall 80 and the discharge opening 12, through which the conveyor passes.

Between the lower extremity of the conveyor and the discharge pipe 22 for the liquid medium, there is preferably a strainer 84 for removing any ice particles from the stream flowing to the pump 23. A removable side wall panel 85 permits access to the strainer 84 for servicing.

The injection of water through the nozzles 21 or other means is preferably at a rate such that the ice particles are large enough to be easily strained in order not to present a problem in the circulation of the cooling medium. As an example, nozzles of 1/16" to ¼" diameter may be used in a typical installation with appropriate adjustment of the flow rate to provide the desired yield.

While various liquid mediums may be used, refrigerants such as R11, trichlorofluoromethane, R21, dichlorofluoromethane and R14, dichlorotetrafluoroethane, are preferred. Each of these is immiscible with water, has a lower freezing point than water, and has a boiling point above the freezing point of water. The boiling point characteristic is preferred because the housing in which the process is carried out has an opening at the side to permit the discharge of ice, thereby exposing its upper portion to atmosphere.

While various operating conditions may be selected, as is well known in the art, it is contemplated that the liquid medium will be maintained at approximately 15° to 20° F. (−9.4° to −6.6° C.).

In the operation of the device, liquid cooling medium is maintained in tank 14 in the bottom of the housing, such liquid being kept at a suitably low temperature for the rapid freezing of water ice. A metered quantity of water is injected into the liquid through the nozzles 21 and rapidly freezes into particles as the stream moves toward the conveyor, such movement occurring due to the constant withdrawal of the liquid refrigerant medium by the pump 23 and passing it in heat exchange relation with evaporator 34. As the ice fragments reach the conveyor, they are lifted upwardly on buckets 76. In their upward passage, the liquid refrigerating medium is drained by gravity, the removal being enhanced due to the fact that the medium is further cooled by the air stream, such cooling further increasing its density and therefore the likelihood of its removal from the ice fragments.

Although the housing has an opening 12 to the atmosphere, the loss of refrigerant and cooling air is reduced due to the provision of a quiescent zone above the path of the air movement.

Figure 2:
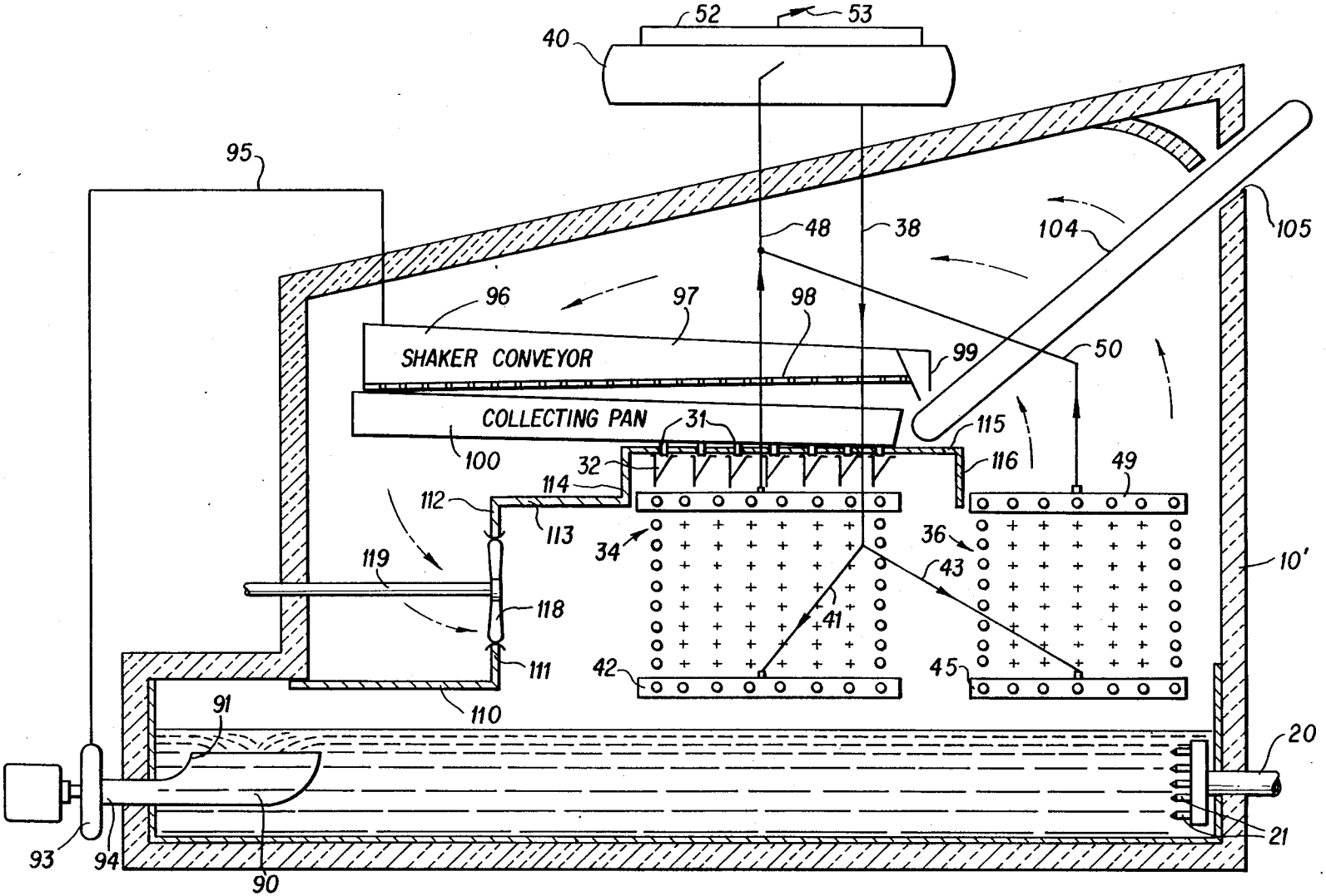
FIG. 2 is a schematic of a modification.

In the modification of FIG. 2, the housing 10' has a collector 90 located in the cooling medium remote from the water inlet nozzles 21. The collector has an opening 91 for receiving ice particles and a quantity of cooling medium and is connected to pump 93 by pipe 94 and by pipe 95 which runs externally of the housing 10' to an elevation and position within the housing over a shaker conveyor 96. Conveyor 96 is of a type well-known in the food industry for water removal and has sides 97 and a movable screen portion 98 which causes the ice particles to move to the right, as viewed in FIG. 2, to the discharge chute 99.

Immediately beneath the conveyor 96 is a collecting pan 100 which forms a header to the individual discharge pipes 31 feeding the troughs 32 over the evaporator coils 34.

The discharge chute 99 carries the ice fragments onto a foraminous discharge conveyor 104 which takes them to the housing discharge opening 105.

Within the housing, the divider walls 110-116 provide an air circuit for the components. Fan 118, mounted between the divider walls 111 and 112, has a shaft 119 driven by a suitable power source (not shown) externally of the housing 10'. The fan draws air across the shaker conveyor 96, the discharge conveyor 94, the auxiliary evaporator 36 and the main evaporator 34, thereby subcooling any liquid adhering to the ice fragments on the shaker conveyor or the discharge conveyor 104 to facilitate its removal from the ice fragments.

I claim:

1. The method of producing water ice fragments in a housing, comprising introducing a metered flow of water beneath the surface of a body of cooling liquid within the housing and at a temperature below the freezing point of water, the cooling liquid normally being non-miscible with the water and having a density greater than water ice, thereby producing ice fragments, passing the cooling liquid in heat exchange relation with cooling means at a temperature below that of the body of cooling liquid, removing the ice fragments from the body of cooling liquid and passing them in heat exchange relation with air at a temperature below that of the body of cooling liquid, thereby subcooling any liquid remaining on said fragments in order to promote the removal therefrom, and discharging the ice fragments from said housing.

2. The invention of claim 1, in which the cooling liquid is passed in heat exchange relation with cooling means positioned over the body of cooling liquid within the housing and permitted to flow downwardly to the body of liquid.

3. The method of claim 1, and screening the ice fragments from the cooling liquid prior to passing the cooling liquid in heat exchange relation with cooling means.

4. The method of claim 1, and cooling the air by flowing it in heat exchange relation with the cooling means.

5. The method of claim 1, and raising the ice fragments above the level of said cooling means prior to discharging them from the housing.

6. The method of claim 5 and discharging the ice fragments above the level of said cooling means.

7. The method of claim 4, and causing the air to flow in heat exchange relation with an auxiliary cooling means out of the path of the descending cooling liquid.

8. Apparatus for freezing water in a liquid cooling medium into fragments of ice and separating them from the medium, comprising housing means, tank means in the housing means, a cooling medium in the tank means, said cooling medium being immiscible with water and having a greater density than water or water ice and having a lower freezing point, means for introducing water at a predetermined flow rate into the cooling medium, cooling means positioned in the housing means above the cooling medium, conveyor means having a lower portion submerged in the cooling medium at a location remote from that at which the water is introduced for removing ice fragments from the medium, said conveyor means extending above the cooling medium and in heat exchange relation with said cooling means, and said housing means having an opening for discharging ice fragments from the conveyor means.

9. The invention of claim 8, means for withdrawing cooling medium from the tank means at a location remote from that at which the water is introduced, and means for causing it to flow downwardly in heat exchange relation with said cooling means on its way back into the cooling medium in said tank means.

10. The invention of claim 8, and means for circulating air in heat exchange relation with said cooling means and over the ice fragments on said conveyor means for removing liquid medium from said fragments.

11. The invention of claim 8, and auxiliary cooling means within the housing means, said auxiliary cooling means positioned out of the path of the downwardly flowing water, and means for circulating air in heat exchange relation with both said cooling means and said auxiliary cooling means, and over the ice fragments on said conveyor means for removing liquid medium from said fragments.

12. The invention of claim 8, and screen means in the tank between the submerged lower portion of the conveyor means and the means for withdrawing cooling medium from the tank means for preventing the flow of ice fragments into the cooling medium withdrawal means.

13. The invention of claim 8, in which the discharge opening in the housing means is at an elevation in spaced relation above the cooling means, and means for circulating air in heat exchange relation with said cooling means and over the ice fragments on said conveyor means, whereby the liquid medium remaining on the ice fragments carried upwardly by the conveyor means is lowered in temperature to assist in its removal from the ice fragments, and whereby a quiescent layer of cooled air is present within the housing means from just above the elevation of the cooling means to the discharge opening and through which the conveyor passes.

14. The invention of claim 8, in which said conveyor means has a first portion that removes ice fragments and cooling medium and a second portion that screens the ice fragments from the cooling medium.

15. The invention of claim 10, in which the conveyor means has a collector for the ice fragments and cooling medium, and pump and conduit means connected to the collector and located externally of the housing means, and a screen means receiving the flow of ice fragments and cooling medium from the conduit means for separating and moving the ice fragments above the cooling means.

16. The invention of claim 11, and means beneath the screen means for causing the cooling medium that passes through the screen means to flow downwardly in heat exchange relation with said cooling means on its way back into the cooling medium in said tank means.

17. The invention of claim 8 in which the cooling means is R11, R21, or R14.

* * * * *